United States Patent [19]

Steinback

[11] Patent Number: 4,513,539

[45] Date of Patent: Apr. 30, 1985

[54] POSITION SETTING DEVICE FOR ABRASIVE BELT GRINDING MACHINE

[75] Inventor: Clarence I. Steinback, Edina, Minn.

[73] Assignee: Acrometal Products, Inc., Minneapolis, Minn.

[21] Appl. No.: 475,534

[22] Filed: Mar. 15, 1983

[51] Int. Cl.[3] ..... B24B 21/00; B24B 49/00

[52] U.S. Cl. ..... 51/138; 51/165.87; 51/165.88

[58] Field of Search ..... 51/135 R, 137–139, 51/165.87, 165.74, 165.75, 165.88

[56] References Cited

U.S. PATENT DOCUMENTS

| | | | |
|---|---|---|---|
| 1,228,798 | 6/1917 | Maag | 51/165.88 |
| 2,528,295 | 10/1950 | Balsiger et al. | 51/165.74 |
| 3,271,909 | 9/1966 | Rutt et al. | 51/138 X |
| 3,691,698 | 9/1972 | Schaller | 51/135 R X |
| 3,782,046 | 1/1974 | Shaap et al. | 51/165.87 X |
| 3,939,611 | 2/1976 | Hesler et al. | 51/139 |
| 4,295,301 | 10/1981 | Barth et al. | 51/165.88 |

OTHER PUBLICATIONS

Promotional Brochure of Grindingmaster Abrasive Grinding Machine Manufactured by Machinefabriek A. van der Linden B. V. Goes-Holland.

*Primary Examiner*—Frederick R. Schmidt
*Assistant Examiner*—Debra S. Meislin
*Attorney, Agent, or Firm*—Merchant, Gould, Smith, Edell, Welter & Schmidt

[57] ABSTRACT

A device for setting the position of a workpiece relative to the endless abrasive belt of an abrasive grinding machine. The device employs a first sensor that can be extended to engage and sense the position of the endless abrasive belt when it is at rest. The device also utilizes a second sensor that can be moved to a position of engagement with the workpiece when it is at rest on a workpiece conveyor. The first and second sensors are constructed and arranged so that the position of one is mechanically related to the position of the other. A movable indicator senses the position of one of the first and second sensors and indicates such position relative to a reference position. The workpiece conveyor can be raised or lowered until the indicator is in the reference position, at which point the distance between the second sensor and the workpiece conveyor corresponds to the distance between the grinding portion of the endless abrasive belt and the workpiece conveyor. Further adjustments to the workpiece conveyor can thereafter be made to surface the workpiece in a desired manner or remove a desired amount of stock.

17 Claims, 8 Drawing Figures

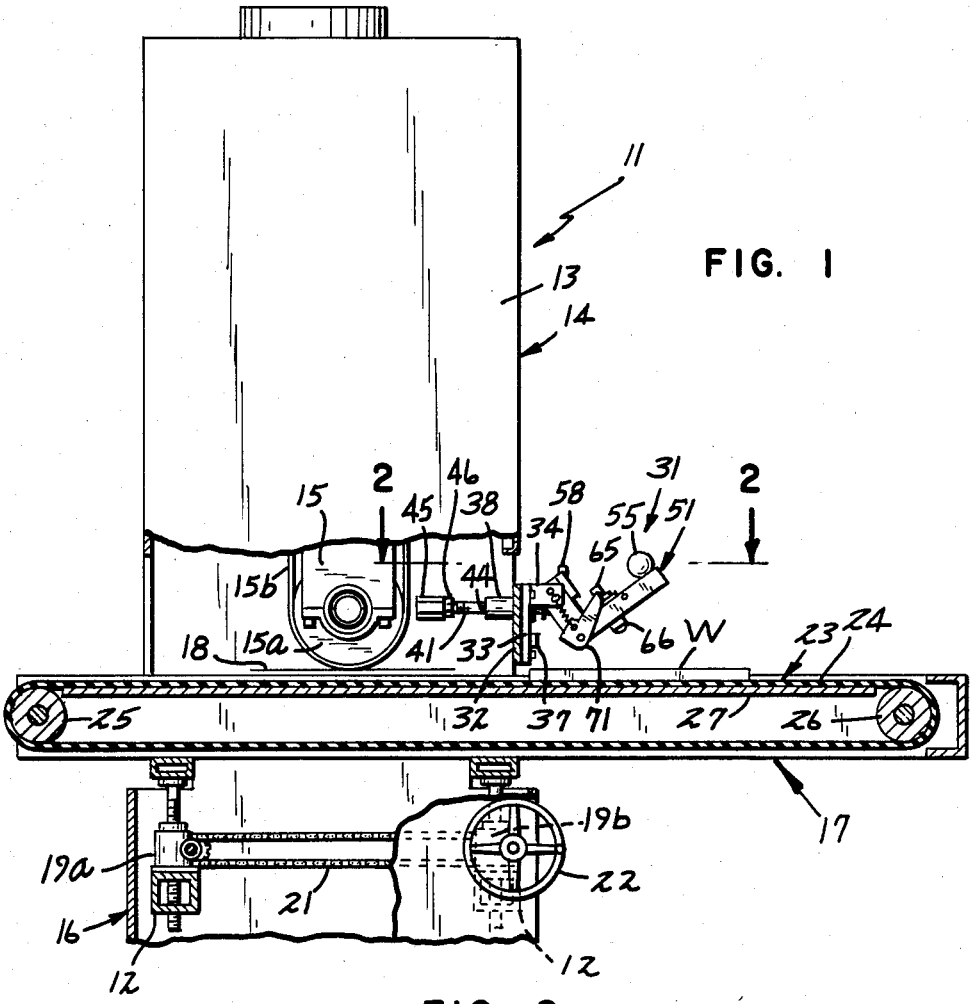
FIG. 1
FIG. 2
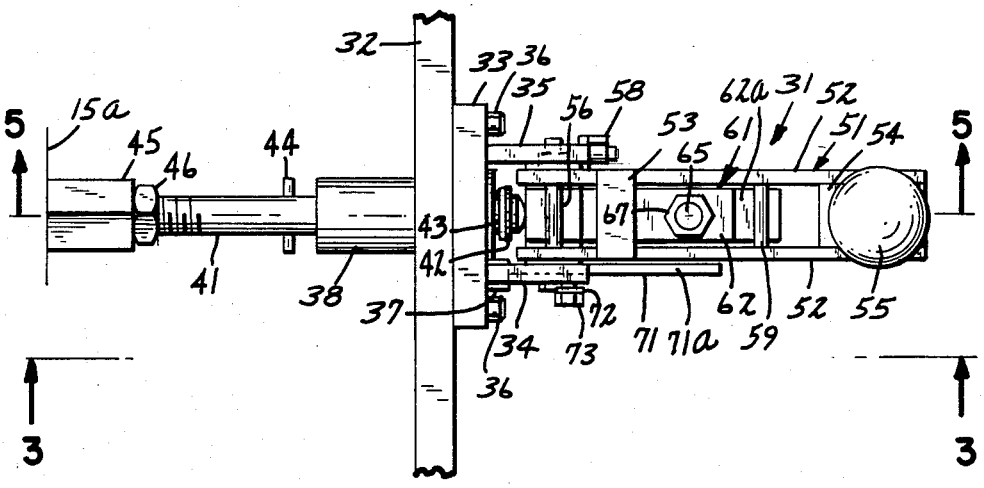

6
7
7

POSITION SETTING DEVICE FOR ABRASIVE BELT GRINDING MACHINE

TECHNICAL FIELD

The invention is directed to a device for establishing a desired relative position between a work piece bed and a workpiece operating means such as the grinding head of an abrasive belt grinding machine.

BACKGROUND OF THE INVENTION

In all types of surfacing operations for workpieces, it is necessary to establish a desired relative position between the workpiece support or bed and the surfacing means to accomplish the desired result. Often the thickness of the workpiece itself is a factor in establishing this relative position.

In a conventional abrasive belt grinding machine, a machine frame suspends an abrasive grinding head in a fixed position over an adjustable bed that carries a horizontally moving workpiece conveyor. The grinding head of the abrasive belt grinding machine typically includes a lower contact drum around which an endless abrasive belt is driven, or a platen over which an abrasive belt moves. In any case, a rigid or yielding backing is provided for the abrasive belt at the line or region of abrasive engagement, and it is this region which must be taken into consideration when the elevation of the workpiece bed and conveyor is adjusted.

One of the problems unique to abrasive belt grinding machines in position setting of the bed is the thickness of the abrasive belt. Abrasive belts vary rather substantially in thickness from fine to coarse grits, and this thickness must be taken into consideration if accurate results are to be obtained. If belt thickness is ignored, a precision finishing operation can vary significantly beyond accepted tolerances simply because an abrasive belt has been changed.

Further, many abrasive belt grinding machines are used for sequential operations starting with a coarse abrasive belt for material removal and ending with a fine abrasive belt to obtain the desired surface finish. If belt thickness is not taken into consideration throughout these operations, many trial and error adjustments will be necessary with the changing of each belt.

Position setting devices for abrasive belt grinding machines are not themselves novel. However, prior art devices either do not take belt thickness into consideration, or require recalibration each time a new belt is installed. In addition, those devices which are capable of taking belt thickness into consideration are generally sophisticated and expensive.

SUMMARY OF THE INVENTION

The subject position setting device is a relatively simple mechanical device that can be installed on virtually any abrasive belt grinding machine, as well as other types of surface operation machines, is relatively inexpensive to manufacture, requires no skill to operate, and automatically takes into consideration the thickness of the abrasive belt on the machine at the time without recalibration.

The inventive position setting device is preferably mounted on the entry safety bar or plate of the machine, which is mounted over the conveyor belt at the point workpieces enter the grinding area. The device is externally accessible for use by the operator, but includes an inwardly extending sensor rod the free end of which engages the abrasive belt and thereby sense its thickness.

The opposite end of this extensible rod bears against one leg of a pivoted, L-shaped lever. The other leg of the lever carries a workpiece sensor. Preferably, the workpiece and abrasive belt sensors are disposed equidistantly from the pivot point for maximum accuracy.

In the preferred embodiment, the L-shaped lever is carried within a larger L-shaped lever one end of which is pivotally connected to a fixed frame, and may be manually moved between a retracted inoperable position and a lower operable position. The inner and outer levers are capable of limited relative movement through the use of biasing springs. The dual lever approach is preferred because of the accuracy it provides, but a single lever could be utilized successfully.

An indicator plate is pivotally mounted to the larger lever and includes a pointer having a home or reference position that relates the position of the workpiece sensor to the position of the grinding head.

When properly calibrated, the position setting device is operated by lowering the outer lever until the workpiece sensor engages a workpiece resting on the workpiece conveyor. Simultaneously, the abrasive belt sensor engages the belt to sense its thickness. Thereafter, the bed is adjusted until the indicator moves to the home or reference position, at which point the top surface of the workpiece is substantially coplanar with the bottom of the grinding head. A desired surface operation may be carried out in this position, or a desired amount of material may be removed from the workpiece by further adjustments of the workpiece bed.

BRIEF DESCRIPTION OF THE DRAWINGS

FIG. 1 is a fragmentary view in side elevation of an abrasive belt grinding machine, portions thereof being broken away and shown in section, and to which a position setting device embodying the invention is mounted;

FIG. 2 is an enlarged sectional view of the position setting device mounted to the abrasive belt grinding machine as taken along the line 2—2 of FIG. 1;

DESCRIPTION OF THE PREFERRED EMBODIMENT

Figures 3, 4:
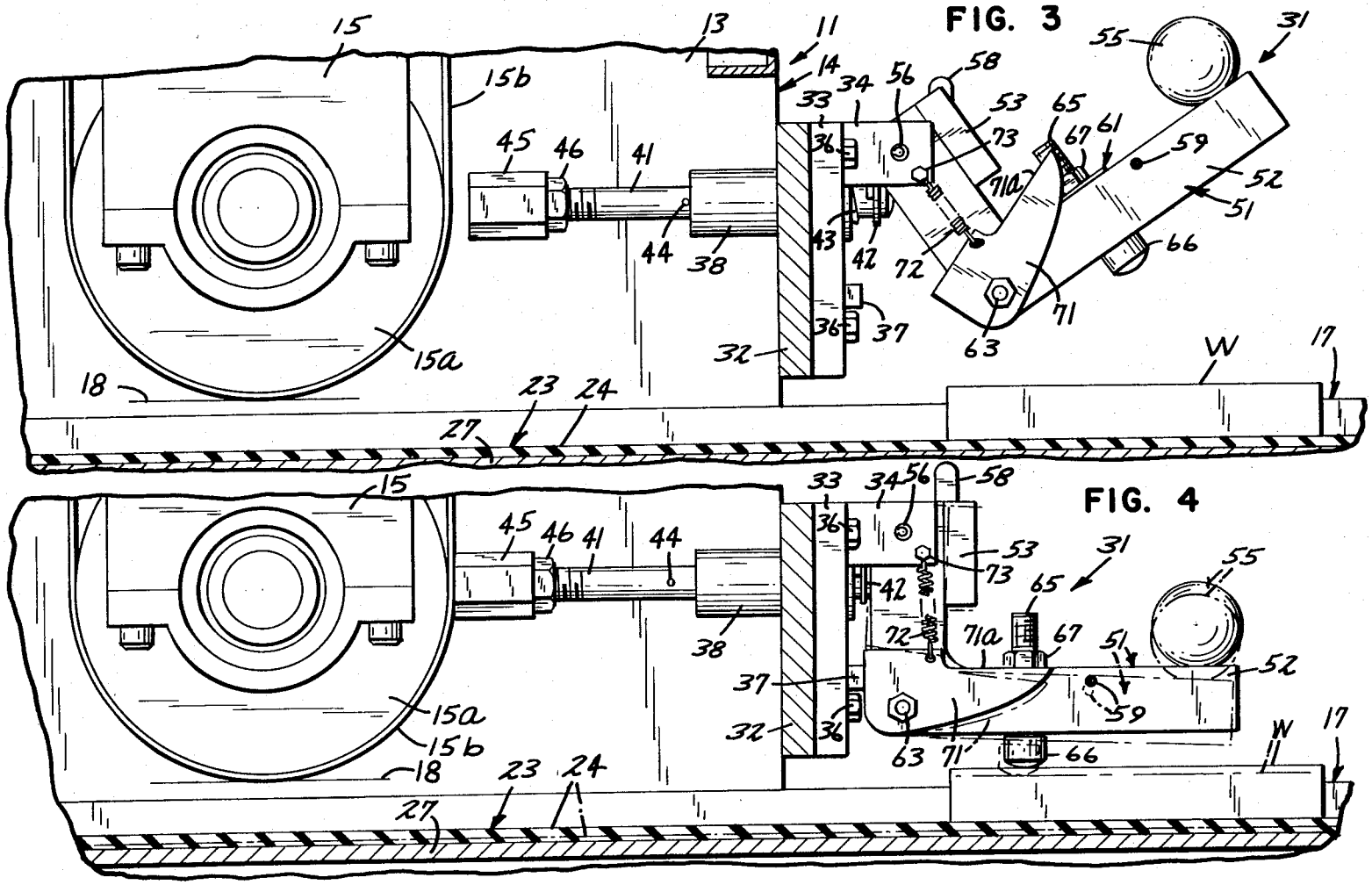
FIG. 3 is a sectional view of the position setting device taken along the line 3—3 of FIG. 2, the device being shown in a raised position relative to a workpiece on the workpiece conveyor.
FIG. 4 is a view similar to FIG. 3, but with the position setting device in a lowered position in engagement with a workpiece.

With initial reference to FIG. 1, an abrasive belt grinding machine represented generally by the numeral 11 is shown to comprise an internal frame consisting of a number of frame components each of which bears the reference numeral 12 for purposes of convenience. An external cabinet 13 encloses the frame 12 and other internal components. Machine 11 further comprises an upper section 14 in which a grinding head 15 is mounted, and a lower section 16 in which a bed 17 is movably supported.

The grinding head 15 is conventional, including a lower contact drum, an upper roller (not shown), and an endless abrasive belt 15*b* encircling the two. The contact drum 15*a* is driven by means not shown in a direction which is counterclockwise as viewed in FIG. 1.

The grinding head 15 is mounted in a fixed position relative to the frame 12 within the upper section 14, and aside from movement of the endless abrasive belt 15*b*, the grinding head 15 is fixed in its position relative to the frame 12.

The endless abrasive belt 15*b* is removably mounted for replacement purposes, and abrasive belts of varying thickness and purpose may be used on the machine 11. For each endless abrasive belt, there is a lowermost point defining a line or region of abrasive contact, and this region lies in a plane that is represented by the numeral 18.

It is possible for the grinding head 15 to be mounted for adjustable movement relative to a stationary bed to vary the space therebetween, but the preferred embodiment is as described above.

The bed 17, which is rectangular in configuration, is horizontally disposed and mounted to the frame of the lower section 16 so that it moves up and down relative to the grinding head 15, while maintaining its horizontal position. This is accomplished with four screw jacks, two of which are shown in FIG. 1 and represented by the numerals 19*a*, 19*b*. The screw jacks 19*a*, 19*b* each constitute one of an aligned pair of screw jacks, and drive shafts commonly drive the respective screw jack pairs. The two drive shafts are operatively connected by a gear belt or chain 21 suitably mounted on sprockets (not shown). A hand wheel 22 is mounted on one of the drive shafts, and its rotation causes the simultaneous and identical actuation of all four screw jacks to raise and lower the bed 17 while maintaining it in a horizontal position.

A workpiece conveyor 23 is mounted on the bed 17, comprising an endless conveyor belt 24 mounted on drive and idler rollers 25, 26. The conveyor belt 24 slides across an underlying flat, horizontal plate 27 forming part of the bed 17.

The position of bed 17, and hence the workpiece conveyor 23, determines the abrasive grinding operation of the grinding head 15 on workpieces W carried by the conveyor belt 24. For example, for workpieces of varying thickness where the desired end result is surfacing to a predetermined specific thickness, it is necessary to initially position the bed 17 so that the spacing or distance between the bed 17 and grinding head 15 represents the desired thickness of the surfaced workpiece.

However, in a more specific application, the objective is to produce a desired surface finish on one of a number of workpieces in which the thickness may vary. Here, the desired end result is not to obtain finished workpieces of the same thickness, but rather to produce the desired finish on the workpieces notwithstanding their thickness.

Conventionally, this is accomplished by trial and error by operating the machine with sample workpieces of the same thickness as one workpiece or a group of workpieces. Alternatively, for each workpiece of different thickness the bed 17 can be lowered until the workpiece clears the grinding head 15, and the bed 17 is moved up progressively after each pass of the workpiece until the desired end result is obtained.

Another alternative is to open the cabinetry of the abrasive belt grinding machine, place the workpiece under the grinding head and move the bed upwardly until engagement occurs.

Each of these approaches is usable, but each is time consuming and produces less than accurate results. The problem is compounded by the thickness of the abrasive belt, which varies from belt to belt as courseness of the grit changes.

The inventive position setting device is intended to overcome these problems and difficulties by enabling the machine operator to quickly and easily set the position of the bed 17 to accomplish the desired surface finish on a workpiece or group of workpieces.

With reference to FIGS. 1–3, a position setting device embodying the invention is represented generally by the numeral 31. As shown in FIG. 1, a safety bar or plate 32 is disposed on edge and extends horizontally across the workpiece inlet of the machine 11. Safety plate 32 is spaced from the workpiece conveyor 23 an amount which permits workpieces W to be admitted to the grinding area under the grinding head 15, while preventing the operator's hands from entering this area.

With reference to FIGS. 2–8, the position setting device 31 includes a stationary frame comprising a rectangular plate 33 (FIG. 6) and a pair of forwardly projecting rectangular ears 34, 35 (FIG. 2). Plate 33 is mounted flush to the front face of the safety plate 32 by four mounting bolts 36, and as shown in FIGS. 3–6, its height corresponds directly to the width of the safety plate 32. Rectangular ears 34, 35 are mounted on edge in spaced, parallel relation, projecting from the top edge of plate 33.

Figures 5, 6, 7, 8:
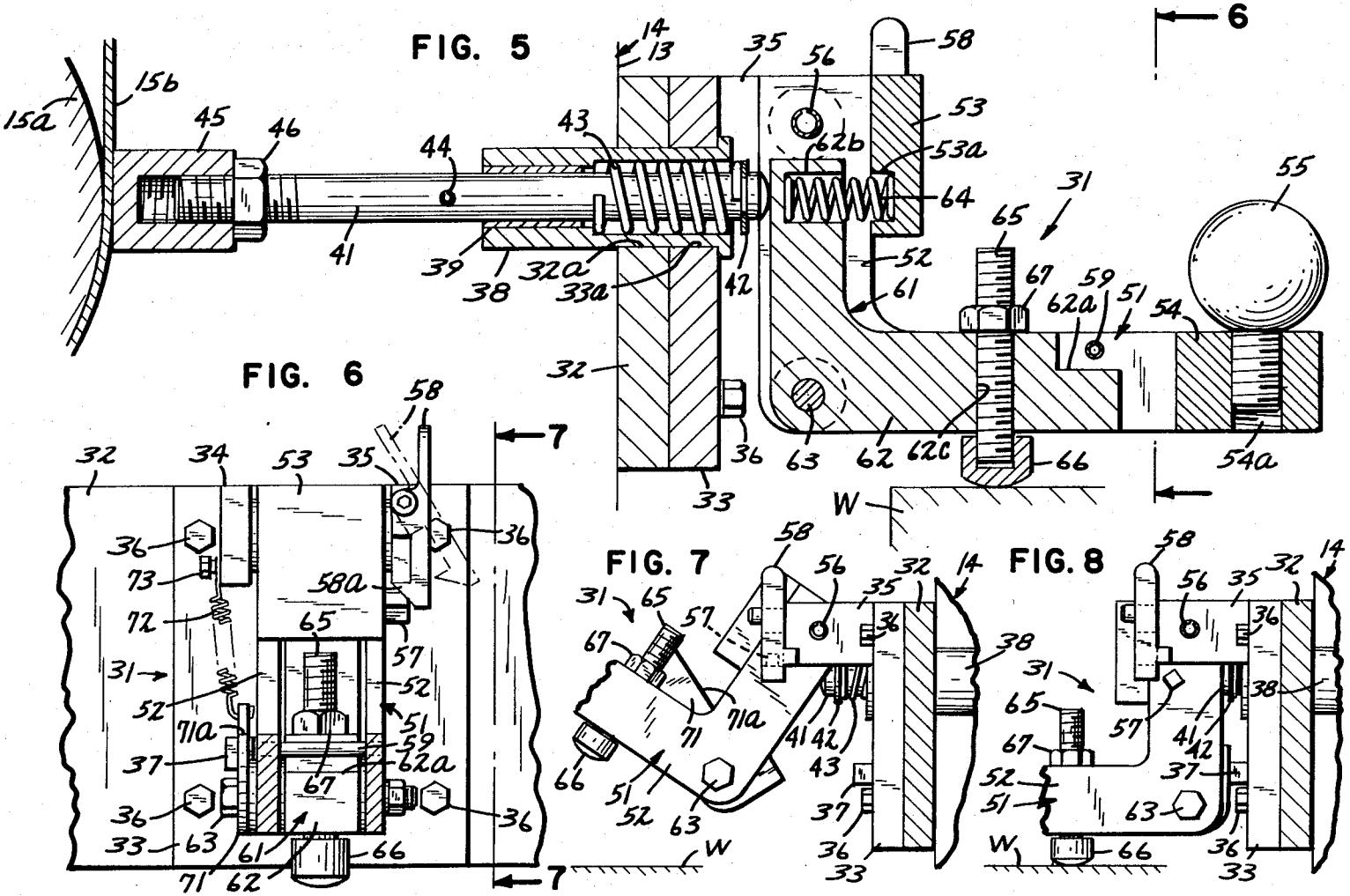
FIG. 5 is a further enlarged sectional view of the position setting device taken along the line 5—5 of FIG. 2.
FIG. 6 is an end sectional view of the device taken along the line 6—6 of FIG. 5.
FIG. 7 is a fragmentary sectional view taken along the line 7—7 of FIG. 6 but with the position setting device in a raised position, and showing a latching mechanism for holding the position setting device in the raised position.
FIG. 8 is a view similar to FIG. 7 but with the position setting device in a lowered position with the latching mechanism disengaged.

With specific reference to FIGS. 2 and 5, a fixed stop 37 is secured to the front face of rectangular plate 33 near its lower edge but slightly off center relative to its vertical axis and beneath the rectangular ear 34.

With continued reference to FIG. 5, a large bore 33*a* is formed through the plate 33 above its horizontal center but centered on the vertical axis of its face. The bore 33*a* is disposed in registration with a bore 32*a* of identical size formed in the safety plate 32. A flanged bushing 38 projects through the bores 33*a*, 32*a* from the front side so that its free end projects rearwardly of the safety plate 32. The bushing 38 has a stepped diameter the larger portion of which opens forwardly. A bearing 39 is inserted into the rear portion having the smaller diameter and is sized to slidably receive a sensor rod 41.

Sensor rod 41 is of constant diameter, the righthand end of which (as viewed in FIG. 5) is crowned to provide a bearing surface. An annular groove is formed adjacent this crown to receive a snap-in keeper ring 42. A coil spring 43 encircles sensor rod 41 and is disposed in compression within the larger diameter bore of bushing 38 between the keeper ring 42 and the diameter step.

As constructed, the sensor rod 41 is urged from left to right as viewed in FIG. 5. A pin 44 extending transversely through the rod 41 acts as a stop to accessive movement of the rod 41 to the right.

The left end of sensor rod 41 is threaded and receives a threaded sensor cap 45. The sensor cap 45 may be adjusted to a desired longitudinal position on the rod 41, and is held in such position by a lock nut 46.

Also as viewed in FIG. 5, it will be seen that the sensor rod 41 is positioned so that it may engage the endless abrasive belt 15*b* at a point where it is backed by the contact drum 15*a*. As such, the position of sensor rod 41 reflects the thickness of abrasive belt 15*b*.

With reference to FIGS. 2–6, position setting device 31 further comprises an outer lever bearing the general reference numeral 51, and an inner lever 61 which is carried within the lever 51. Levers 51, 61 are both L-shaped in configuration, each having first and second legs that are substantially perpendicular in the preferred embodiment. As described below, the levers 51, 61 are both pivotally movable relative to the stationary frame and are also movable to a limited degree relative to each other.

Outer lever 51 comprises a pair of L-shaped plates 52 that are held in parallel, spaced relation by a spring retention plate 53 and a handle support block 54. Plate 53 is secured to the upper front edge of the plates 52, as by welding. As best shown in FIG. 5, a cylindrical recess 53*a* is formed in the inner face of plate 53 near its bottom edge.

Handle support block 54 is secured between the plates 52 at their forwardmost point, also as best shown in FIG. 5. A threaded bore 54*a* is formed in the block 54 and receives a handle knob 55 used for manual manipulation of the device 31.

A pivot bolt 56 extends through registering bores in the rectangular ears 34, 35 and the top of L-shaped plates 52, permitting the outer lever 51 to be lifted pivotally as shown in FIGS. 3 and 7.

With specific reference to FIGS. 6–8, a small square boss 57 is secured to the outer face of the righthand plate 52 (FIG. 6). The boss 57 is disposed and configured to cooperate with a latch 58 that is pivotally mounted to the rectangular ear 35. A dog or tooth 58*a* is formed at the bottom of the pivot latch 58 and disposed to engage the boss 57 with the outer lever 51 elevated in the position shown in FIG. 7. The latch 58 is normally held by gravity into the vertical position shown in FIG. 6, and the dog 58*a* has an inclined cam surface which the boss 57 engages as the lever 51 is elevated. As this happens, the latch 58 is momentarily moved laterally outward, and after the boss 57 passes by, the latch 58 returns by gravity and prevents the lever 51 from downward movement. In order to manipulate the lever 51 downward, the latch 58 must be intentionally released by moving it laterally inward, as shown in FIG. 6.

The inner lever 51 comprises an L-shaped block 62 the thickness of which enables it to be disposed between the L-shaped plates 52 of lever 51. As best shown in FIG. 5, the L-shaped block 62 has legs that are respectively shorter than the legs of the lever 51.

L-shaped block 62 is pivotally mounted to the lever 51 by a pivot bolt 63 at the common juncture of their legs, permitting relative movement between the two. The horizontal leg of L-shaped block 62 has a stepped recess 62*a*, and pivotal movement is limited in the counterclockwise direction by a transverse pin 59 extending through the plates 52.

The vertical leg of L-shaped block 62 has a cylindrical recess 62*b* that is disposed in opposition to the recess 53*a*, and a coil spring 64 is compressibly disposed in these recesses. Spring 64 urges the vertical legs of the levers 51, 61 apart.

A vertical threaded bore 62*c* is formed in the horizontal leg of L-shaped block 62 toward its outer end and receives a threaded sensor bolt 65. The lower end of the bolt 65 projects below the horizontal leg and receives a threaded nylon sensor cap 66. The amount which the sensor cap 66 projects from the horizontal leg of block 62 is adjustable, but once the desired position is established the position is held by a lock nut 67.

As constructed, the sensor rod 41 is normally urged into engagement with the vertical leg of block 62 near its top. This point of engagement lies on the longitudinal axis of rod 41 which substantially coincides with the axis of coil spring 64. These axes lie a predetermined distance from the pivot pin 63 which is the same as the distance between the pivot pin 63 and the longitudinal axis of sensor bolt 65. Accordingly, movement by either the sensor rod 41 or sensor bolt 65 is transmitted directly to the other in a 1:1 ratio. This construction provides for excellent accuracy and avoids the mechanical amplification of errors that might otherwise occur.

With reference to FIGS. 3, 4 and 6, an indicator 71 is mounted on the pivot bolt 63 on the outer face of the outer lever 51 for pivotal movement with respect thereto. Indicator 71 is normally urged upwardly by a coil spring 72 mounted in tension between a small hole in its upper edge and a screw 73 in the rectangular ear 34. Indicator 71 is formed from metal plate with an irregular shape generally having the general appearance of a shoe.

As is best shown in FIG. 6, the indicator 71 is disposed in alignment with the fixed stop 37. As shown in FIG. 4, the rear edge of the indicator 71 engages the fixed stop 37 when the device 31 is lowered, and the more the outer lever 51 is lowered, the more the indicator 71 is forced in a clockwise direction (as viewed in FIG. 4) by the fixed stop 37.

The indicator 71 has an upper edge 71*a* that is capable of horizontal orientation, and it achieves a "home" position when the edge 71*a* is in alignment with the upper horizontal edge of lever 51 as shown in FIG. 4.

As constructed, it will be appreciated that the position setting device 31 has a raised or inoperative position as shown in FIG. 3 and a lowered or operative position as shown in FIG. 4. The raised position is the normal position and is assumed when no manual force is applied to the device through the knob 55. Under this circumstance, the sensor rod 41 is urged by the spring 43 from left to right (as shown in the Figures), and its engagement with the inner lever 61 forces the inner lever 61 and outer lever 51 upward together. As described above in connection with FIGS. 7 and 8, the dog 58*a* engages the square boss 57 in this position, and prevents the position setting device 31 from being lowered until the latch 58 is released by lateral inward movement. When the latch 58 is released, the device 31 may be lowered manually by exerting force on the handle knob 55.

The position setting device 31 must be calibrated before use. With an abrasive belt 15*b* mounted on the grinding head 15, and with the machine 11 inoperative, a workpiece W having the desired surface finish is placed under the position setting device 31, and the lever 51 is lowered by the operator releasing the latch 58 and grasping the knob 55. As the lever 51 is lowered, the inner lever 61 is carried pivotally downward with it and urges the sensor rod 41 outward toward abrasive belt 15*b*. When the threaded sensor cap 45 engages the abrasive belt 15*b*, it senses its position by ceasing further longitudinal movement. Thereafter, the rod 41 is urged against the vertical leg of inner lever 61, attempting to force the lever 61 clockwise. However, this is opposed by the compression spring 64, which transmits the force to the spring retention plate 53, thus attempting to move the inner lever 51 in a counterclockwise direction. Such movement is opposed by the operator in applying downward force to the knob 55.

At the same time, the force of the sensor rod 41 causes the inner lever 61 to move clockwise so that the nylon sensor cap 66 is forced into engagement with the workpiece W. The relative position of the components is reflected by the indicator 71.

In the calibration process, the objective is to adjust the device 31 so that the bottom of the nylon sensor cap 66 lies in the plane 18 at the time of its engagement with the top surface of the workpiece W, and with the threaded sensor cap 45 in engagement with the endless abrasive belt 15*b*. This is accomplished by adjusting the sensor cap 45 or 66 with the calibration workpiece W so that both are in engagement with the abrasive belt 15*b* and workpiece W, respectively, and at the same time the edge 71*a* of indicator 71 is in alignment with the top edge of lever 51.

After calibration has been accomplished, the position setting device 31 may be easily and quickly used to position the bed 17 and conveyor 23 at a position so that the top surface of any workpiece W will lie in the plane 18; i.e., the top of the workpiece W will just be in contact with the abrasive belt 15*b* as it passes through the region of abrasive contact at the bottom of contact drum 15*a*. To do so, the bed 17 is initially lowered by hand manipulation of the hand wheel 22 to a point where there is adequate clearance. The workpiece W is then placed on the conveyor belt 24 beneath the position setting device 31.

Assuming that the device 31 is in the elevated or inoperable position shown in FIGS. 1, 3 and 7, the latch 58 must be manually released before the bed adjustment can be made. Upon release, the operator grasps the knob 55 and moves the outer and inner levers 51, 61 down to the operable position. Such movement is against the bias of the coil spring 43 and simultaneously forces the sensor rod 41 outward into engagement with the abrasive belt 15*b*. Resistance to further movement is encountered at the point of such engagement.

At this point, the hand wheel 22 is rotated to elevate the bed 17 until the top surface of the workpiece W engages the nylon sensor cap 66. At the point of engagement, the device 31 will be in the position represented by the phantom lines in FIG. 4, and the upper edge 71*a* of indicator 71 will not be parallel with the upper edge of lever 51. However, as the hand wheel 22 is rotated in the bed 17 further elevated, this movement forces the inner lever 61 and outer lever 51 upward or in a counterclockwise direction about the pivot pin 56, and at the same time the indicator 71 is permitted to move upward or in a counterclockwise direction about the pivot bolt 63 by virtue of its relationship with the fixed stop 37. At the point that the edge 71*a* of indicator 71 becomes parallel with the upper edge of lever 51, the top surface of the workpiece W and the extreme bottom of the abrasive belt 15*b* and contact drum 15*a* are substantially coplanar, and with knowledge of this fact the desired machine operation may be carried out.

In this regard, the setting obtained may be used to produce a desired surface finish identical to the surface finish of the calibrated workpiece. Thus, with the top of the workpiece W substantially coplanar with the bottom of the grinding head 15, a limited degree of abrasive contact will occur as the workpiece W is moved beneath the grinding head 15 by the conveyor belt 24, obtaining the desired finish surface.

However, with the knowledge that the top of the workpiece W is substantially coplanar with the bottom of the grinding head 15, it is also possible to further elevate the bed 17 by rotation of the hand wheel 22 to remove a desired amount of material from the workpiece W. In this regard, it is conventional for an abrasive belt grinding machine to include some type of readout, often digital, indicating the position of the bed 17. If the readout is noted when the position setting device 31 brings the workpiece W at the level of the grinding head 15, the hand wheel 22 may thereafter be simply rotated further, and the readout will indicate the difference in bed position; i.e., the amount of material to be removed from the workpiece W.

After use, the position setting device 31 is elevated to the position shown in FIGS. 1, 3 and 7, and the latch 58 engages the boss 57 to hold the device in this inoperable position. While the bias provided by the spring 43 would itself maintain the levers 51, 61 in this elevated position, the additional function of the latch 58 prevents the device 31 from being inadvertently lowered while the abrasive belt grinding machine 11 is running. If this were to happen, the sensor cap 45 would engage the moving abrasive belt 15*b*, resulting in damage to the belt and perhaps the sensor cap itself. The gravity latch 58 requires the operator to make a conscious decision prior to use of the device 31.

It will be appreciated from the foregoing that the position setting device 31 is extremely simple to use, and enables an operator to quickly set the position of the bed 17 to quickly bring the top surface of a workpiece W to the same level as the bottom of grinding head 15. In performing this simple operation, the thickness of the belt 15*b* is automatically taken into consideration by the sensor cap 45, and there is no need to open the cabinet 13 of the machine 11.

What is claimed is:

1. A position setting device for an abrasive belt grinding machine having a grinding head with an endless abrasive belt of predetermined thickness, and a workpiece conveyor that is adjustably movable relative to an abrasive grinding region on the endless abrasive belt, the position setting device comprising:

frame means adapted for connection to a stationary portion of the abrasive belt grinding machine;

first sensor means carried by the frame means for movement between a retracted position and an extended position in which it engages and senses the position of the abrasive belt of the grinding head;

second sensor means carried by the frame means for movement between a retracted position and an extended position in which it engages and senses the position of a workpiece disposed on the workpiece conveyor and a retracted position;

the first and second sensor means being constructed and disposed so that the position of one is related to the position of the other;

and movable indicator means having a predetermined reference position for sensing the position of one of said first and second sensor means, and for indicating such position relative to said reference position;

the first and second sensor means and the indicator means being relatively disposed and arranged so that the second sensor means is spaced from the workpiece conveyor a distance which is the same as the distance between the grinding portion of the endless abrasive belt and the workpiece conveyor when the first sensor means is in engagement with the endless abrasive belt and the indicator means is in said predetermined reference position.

2. The device defined by claim 1, wherein the first sensor means comprises:

an elongated rod guidably carried by the frame means for movement along its longitudinal axis;

and spring means for normally urging the elongated rod toward its retracted position.

3. The device defined by claim 2, wherein the second sensor means comprises:

manually movable lever means pivotally carried by the frame means for engagement with one end of said elongated rod;

a sensor member carried by the lever means for movement between said extended and retracted positions as the lever means is pivotally moved;

the elongated rod and lever means being so disposed that the elongated rod extends against the bias of the spring means when the lever means is pivotally moved to extend the sensor member.

4. The device defined by claim 3, wherein the indicator means comprises a pointer member pivotally carried by the lever means and disposed to be pivotally moved by abutable engagement with the frame means.

5. The device defined by claim 3, wherein the lever means comprises:

first and second levers of generally L-shaped configuration and each having first and second angularly disposed legs;

the first lever being pivotally mounted to the frame means by its first leg and the second leg being manually movable;

the first and second levers being commonly and pivotally connected at substantially the juncture of their first and second legs;

the first leg of the second lever being disposed for engagement with said one end of the elongated rod, and said sensor member being mounted to the second leg thereof;

and means for biasing the first legs of the first and second levers apart.

6. The device defined by claim 5, wherein the distance between said juncture pivot and the point of engagement of the elongated rod and first leg of the second lever is substantially the same as the distance between said juncture pivot and said sensor member.

7. The device defined by claim 5, wherein said biasing means comprises a coil spring having an axis that is colinear with the axis of said elongated rod.

8. The device defined by claim 5, wherein the first lever comprises spaced side members and the second lever is disposed therebetween.

9. The device defined by claim 5, which further comprises handle means mounted on the second leg of the first lever for manual manipulation thereof.

10. The device defined by claim 5, wherein the indicator means comprises a pointer member pivotally carried by the first lever and disposed for engagement with the frame means to effect indicating movement as a function of position of the first lever.

11. The device defined by claim 10, wherein the frame means comprises a fixed stop disposed for engagement by said pointer member.

12. The device defined by claim 10, wherein the second leg of the first member and the pointer member define straight edges that are proximately disposed and relatively movable into and out of parallel alignment, and said predetermined reference position is defined by said straight edges reaching parallel relation.

13. The device defined by claim 12, wherein the indicator member is pivotally mounted at said juncture pivot.

14. The device defined by claim 10, which further comprises spring means for urging the pointer member into engagement with said frame means.

15. The device defined by claim 1, wherein the first and second sensor means are adjustably carried to permit calibration.

16. The device defined by claim 1, which further comprises releasable latch means for holding the second sensor means in said retracted position.

17. A position setting device for use on a workpiece surfacing machine to establish a desired relative position between the workpiece surfacing means of the machine and the workpiece support therefor, the device comprising:

stationary frame means;

first sensor means movably carried by the frame means for engaging and sensing the position of the workpiece surfacing means;

second sensor means movably carried by the frame means for engaging and sensing the position of a workpiece on the workpiece support;

means for relating the position of the first and second sensor means so that the position of one is related to the position of the other;

and indicator means having a predetermined reference position for sensing the position of one of said first and second sensor means, and for indicating such position relative to said predetermined reference position.

* * * * *